US008356802B2

(12) United States Patent
Reich

(10) Patent No.: US 8,356,802 B2
(45) Date of Patent: Jan. 22, 2013

(54) HANDRAIL ASSEMBLY AND METHOD

(76) Inventor: David Reich, Westmount (CA)

( * ) Notice: Subject to any disclaimer, the term of this patent is extended or adjusted under 35 U.S.C. 154(b) by 96 days.

(21) Appl. No.: 12/802,053

(22) Filed: Jun. 1, 2010

(65) Prior Publication Data

US 2011/0017969 A1 Jan. 27, 2011

Related U.S. Application Data

(60) Provisional application No. 61/213,858, filed on Jul. 22, 2009.

(51) Int. Cl.
*E04H 17/00* (2006.01)

(52) U.S. Cl. ..... 256/65.16; 256/65.09; 256/65.15

(58) Field of Classification Search .... 256/65.07–65.09, 256/65.01, 65.16, 72; 248/220.21, 251, 300, 248/304, 305; 403/252–254, 353, 348
See application file for complete search history.

(56) References Cited

U.S. PATENT DOCUMENTS 3,007,678 A * 11/1961 Buehler ..... 256/65.07
3,026,080 A * 3/1962 Thurnauer ..... 248/251
3,161,425 A 12/1964 Aho et al.
3,164,354 A * 1/1965 Murdock ..... 248/251
3,223,371 A * 12/1965 Miller ..... 248/251
3,306,585 A * 2/1967 Blum ..... 256/69
3,306,641 A * 2/1967 Blum et al. ..... 403/219
3,351,324 A * 11/1967 Blum et al. ..... 256/68
3,433,460 A * 3/1969 Kusel et al. ..... 256/65.16
3,544,072 A * 12/1970 Wenzel ..... 256/59
4,035,097 A * 7/1977 Bachand ..... 403/348
4,102,529 A * 7/1978 Neblung et al. ..... 256/70
4,220,316 A * 9/1980 Naka et al. ..... 256/59
4,830,531 A * 5/1989 Condit et al. ..... 403/348
5,427,359 A * 6/1995 Moulton ..... 256/59
5,469,682 A * 11/1995 Knight ..... 52/718.01
5,529,288 A * 6/1996 Cheng-I ..... 256/65.16
6,176,472 B1 * 1/2001 Burger ..... 256/59
7,815,389 B2 * 10/2010 Wagner et al. ..... 403/306
2010/0252792 A1 * 10/2010 Bennett ..... 256/21

* cited by examiner

*Primary Examiner* — Joshua Kennedy
(74) *Attorney, Agent, or Firm* — Mila Shvartsman

(57) ABSTRACT

A handrail assembly that can be installed on any wall. The assembly has a handrail and a bracket. The bracket can be twist-locked inside the handrail at any point in the handrail because the handrail has a continuous T-shaped channel at the bottom. The T-shaped channel's bottom portion is narrower than the upper portion. The bracket has a head that is as wide as the T-shaped channel's bottom portion and as long as the T-shaped channel's upper portion. The head has one curved corner to facilitate turning and teeth to bite into the upper portion of the channel's wall. The head is lifted through the bottom portion into the upper portion of the channel, the bracket is rotated a quarter turn, and the bracket becomes immobilized. The head of the bracket acts as a cam. Union joints can join multiple lengths of handrails.

6 Claims, 11 Drawing Sheets

HANDRAIL ASSEMBLY AND METHOD

This application is based on the provisional patent application 61/213,858 filed on Jul. 22, 2009. The present invention relates to a handrail assembly, and more particularly to an assembly that can be easily attached to almost any place where ambulatory support is necessary, being a wall in a residence, inhabited space, or outside vertical surface. This assembly is easy to install, remove, and very inexpensive to manufacture. It provides a modular solution to the growing population of aging citizens, and can extend a user's period of independent home living by several years.

BACKGROUND OF THE INVENTION

Demographic statistics show an aging population. Older people are more prone to injuries and ailments that impair their mobility, and benefit from installation of railings that minimize risk of falling. Stroke victims are often incapable of using a walker requiring strength in both arms and must have secure railings to remain ambulatory. Railings are especially important in washrooms, shower stalls, kitchens and other occupancies with floors that are not always slip-resistant. Exterior walks and ramps subject to ice formation are safer with handrails secured to adjoining walls. Building codes mandate railings along stairways. The large and growing market will benefit from the availability of quickly installed, economical handrails that this invention promises.

There is known U.S. Pat. No. 3,162,425, which describes a hand rail for stairways using clamps to affix a railing to a wall. However, this uses regular screws to attach the rail to the clamps, and requires a lot more time to install or modify its location.

There is also known U.S. Pat. No. 3,306,641, which uses knurls to hold a railing in place. However, this design is flawed due to the fact that it is not resistant to abrupt twisting impacts, as it is installed to be removable by a twisting motion. It is also more expensive to produce.

There is also known U.S. Pat. No. 5,529,288, wherein a railing is slid into place over a support means and immobilized by screws. This design is also not as easy to use as the present invention, as it requires immobilization by screws.

The present invention overcomes the drawbacks of the cited prior art: it provides a rigid handrail, very easily installable in almost any environment, and very inexpensive to manufacture. This invention can be sold in any hardware store, with self-explanatory instructions for the do-it-yourselfer or handyman.

OBJECT OF THE INVENTION

It is the object of the present invention to provide a secure handrail assembly for users with impaired mobility, this system being easily installable to any surface encountered in a residential or commercial environment, and priced very affordably.

These goals are accomplished by a standardized assembly comprising only two components: a railing and a bracket. The bracket head mates with a channel inside the railing to be immobilized at any point in the railing, resulting in an aesthetically-attractive handrail that can be installed in corridors, halls, rooms, and anywhere else a user requires a hand-hold.

Due to the simplicity of the present invention and its components, its cost can be greatly reduced if compared to the current state of the art. Components can be sold directly to the consumer, and proper installation can be performed in minutes.

SUMMARY OF THE INVENTION

The system consists of handrails supported on brackets secured to walls. The handrails:

1. Are cut to any convenient length; minimizing the number of joints improves the appearance, comfort and security of the railings and provides users with uninterrupted support for hand movement.
2. Are designed to be fitted with brackets that are easily and securely twisted into place anywhere along their length without use of tools.

Prior to Installation:

1. Any studs or furrings within the walls are located,
2. The brackets are twisted into the handrail to suit the spacing of any studs or furrings; on solid walls (i.e. masonry, concrete) the brackets are set at intervals recommended in installation instructions.
3. The assembled handrail-bracket lengths are screwed through the wall finishes to the studs or furrings within the walls, or directly to solid surfaces, using conventional fasteners.

The preferred embodiment of the present invention comprises the following elements:

In the preferred embodiment, the handrails are aluminum tubular extrusions with factory applied coatings or anodized surfaces. The handrail has a channel that is designed to receive a bracket's head. These brackets can be twisted into place anywhere along the rail's length. The brackets can just as easily be unlocked by twisting them in the opposite direction. The handrails are cut to any desired length. If the handrail is made of a flexible material, the 'twist-lock' principle is facilitated by the vertical stress-relief channel forming part of the handrail extrusion; this allows the handrail channel to flex to receive the diagonal dimension of the bracket head during installation without distorting the exterior profile. In the preferred embodiment of the present invention, in cross-section, the channel is of a T-shape configuration. If the rail is made of a rigid material such as heavy-gauge aluminum, the channel can be of an uppercase "T" configuration, since the material will not flex. If the rail is made of a more flexible material, the channel can be of a lowercase "t" configuration, wherein the uppermost part of the channel comprises the stress-relief channel.

Brackets of aluminum, steel, zinc, brass or any other material strong enough to support the weight of the user are designed to twist into the handrail; no fasteners are required. The bracket's wall support portion is flat, permitting it to be securely fastened directly and tightly to masonry or concrete, or through drywall finishes secured over metal or wood studs or furrings. Holes are provided to accommodate screws or bolts. Bracket finishes can match their handrails. The bracket is attached to the handrail via the bracket's attachment head. This rail attachment head has the following characteristics: insertable into the handrail's channel at any point, twisted a quarter turn, and remain securely attached to the handrail. In another embodiment of the present invention, the rail attachment head has a through-hole (not shown), and once the rail attachment head has been securely fastened to the handrail, a fixing screw can be inserted through the through-hole, and screwed into the handrail's stress-relief channel for additional holding power.

Screws or bolts will be supplied by the user or the installer to suit any wall construction; these will be secured through pre-formed holes in the wall attachment portions. It will be recommended that these fasteners will be of steel, galvanized or otherwise coated to minimize risk of rusting, of gauge and length required to reach and penetrate solid portions of the wall, either into or through wood or metal studs, or solid masonry, or other materials capable of permanently sustaining the anticipated stresses. These fasteners are readily available in a great variety of configurations, and their supply and installation are not the responsibility of the manufacturer or seller of the handrails. These elements are not part of the invention.

The longer lengths of handrails result in few or no intermediate joints; the simple connection of brackets to handrails reduces labor costs and minimizes disruption during reduces labor costs and minimizes disruption during the construction period. Should the distance of required railing along a wall exceed the maximum available handrail length, plastic or metal union joints can be inserted into the handrail's ends, thereby providing a continuous gripping surface, aesthetic qualities, and ensuring that handrail lengths are be aligned. The union joints do not function as structural support for a user's weight between handrails; structural support is provided via wall brackets at pre-determined distances. Such union joints can join linear or non-linear segments of the handrail. At terminal ends, handrails will be neatly closed off by end caps.

DETAILED DESCRIPTION OF THE PREFERRED EMBODIMENT

The present invention can be represented in many different variants. However, the essence of this invention resides in its ability to provide a stable handrail in almost any setting, providing there is a wall. The following two variants of the preferred embodiment are based on the objective to reduce manufacturing costs yet provide a product that can bear the weight of an average person.

Figure 1:
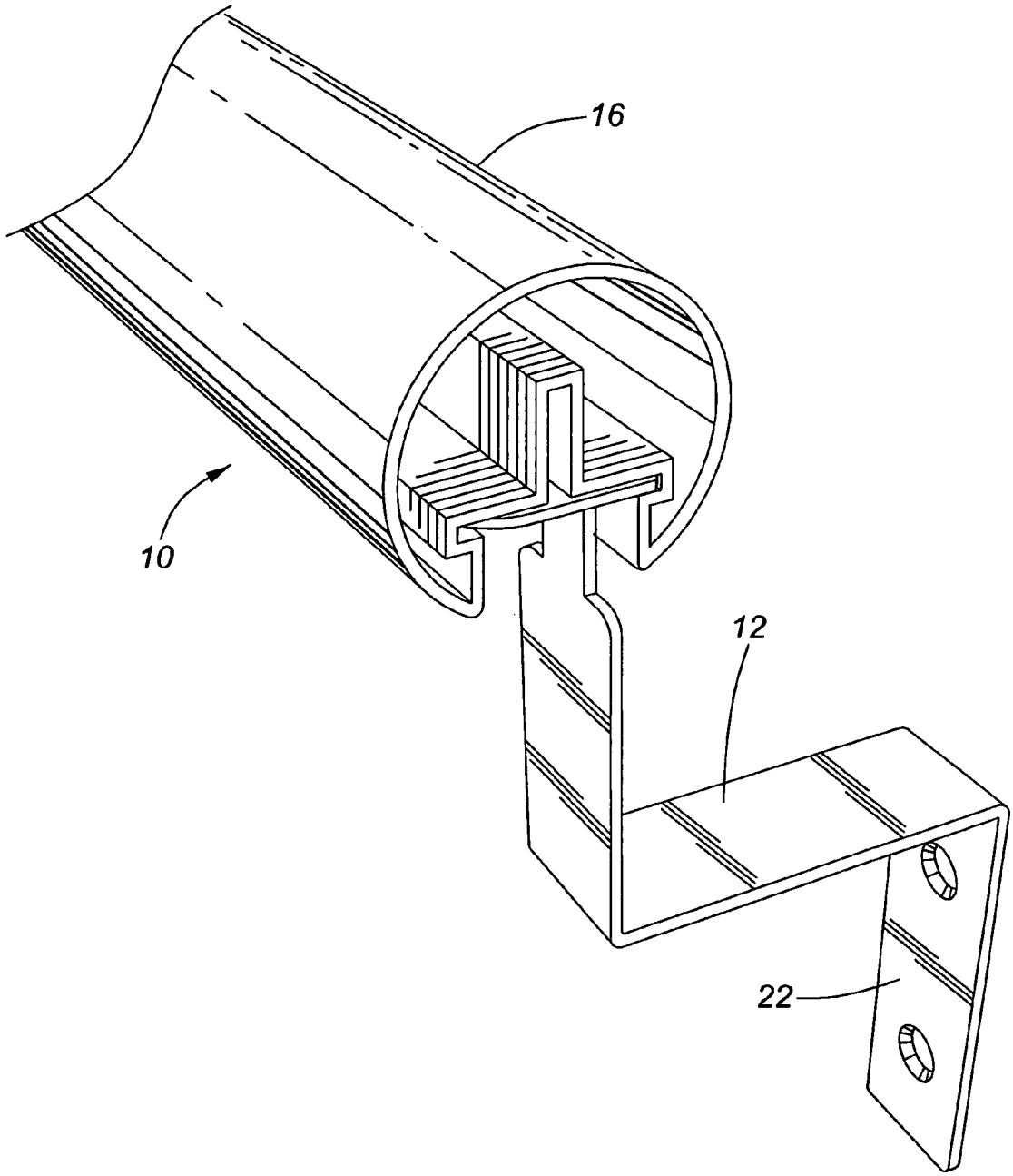
FIG. 1 shows the perspective view of Variant 1 assembly of the present invention's preferred embodiment.
Figure 2:
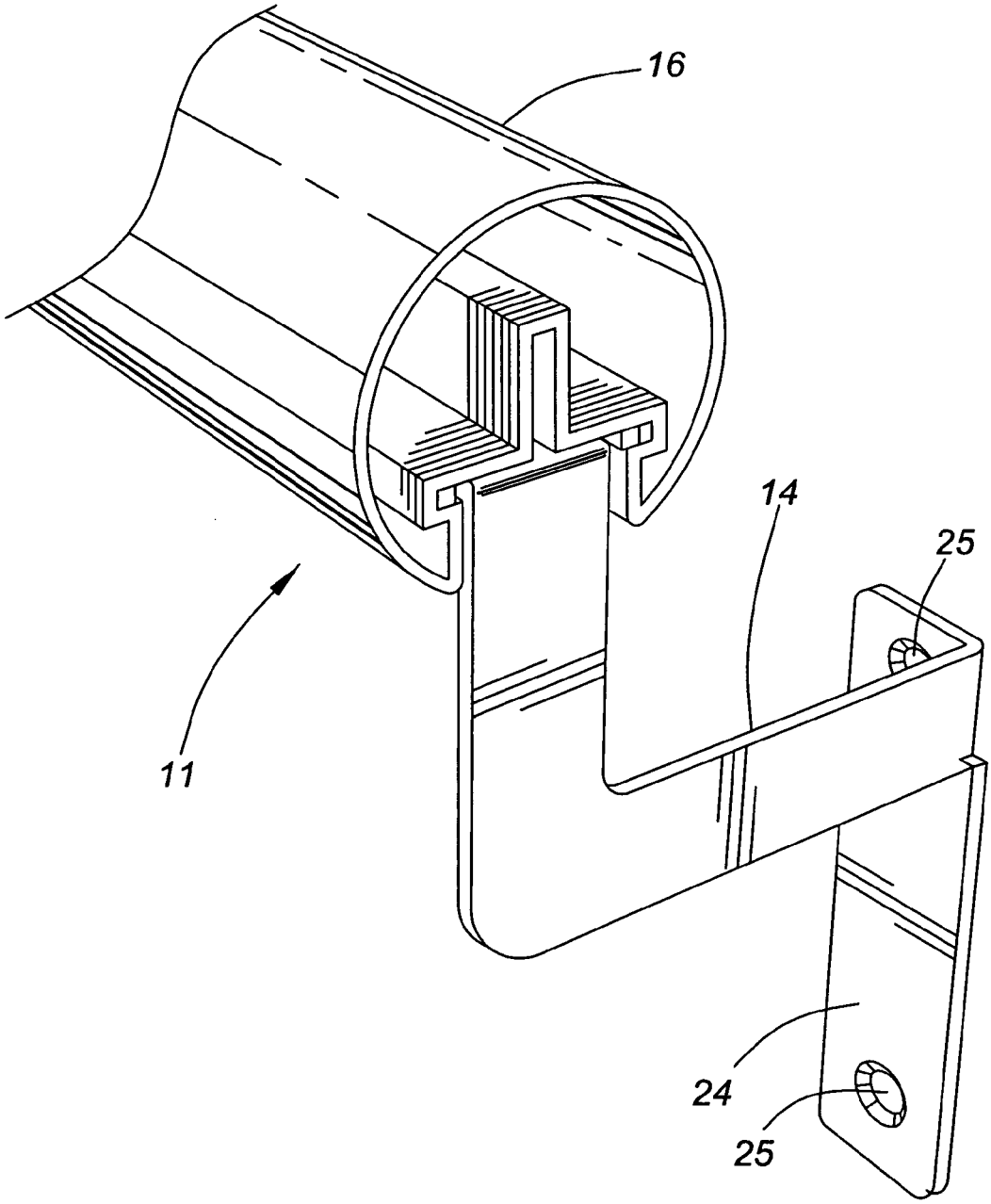
FIG. 2 shows the perspective view of Variant 2 assembly of the present invention's preferred embodiment.

Referring now to figures, FIG. 1 shows Variant 1 of the present invention. This variant comprises assembly 10, consisting of bracket 12 and railing 16. FIG. 2 shows Variant 2, comprising assembly 11, consisting of bracket 14 and railing 16.

Figure 3:
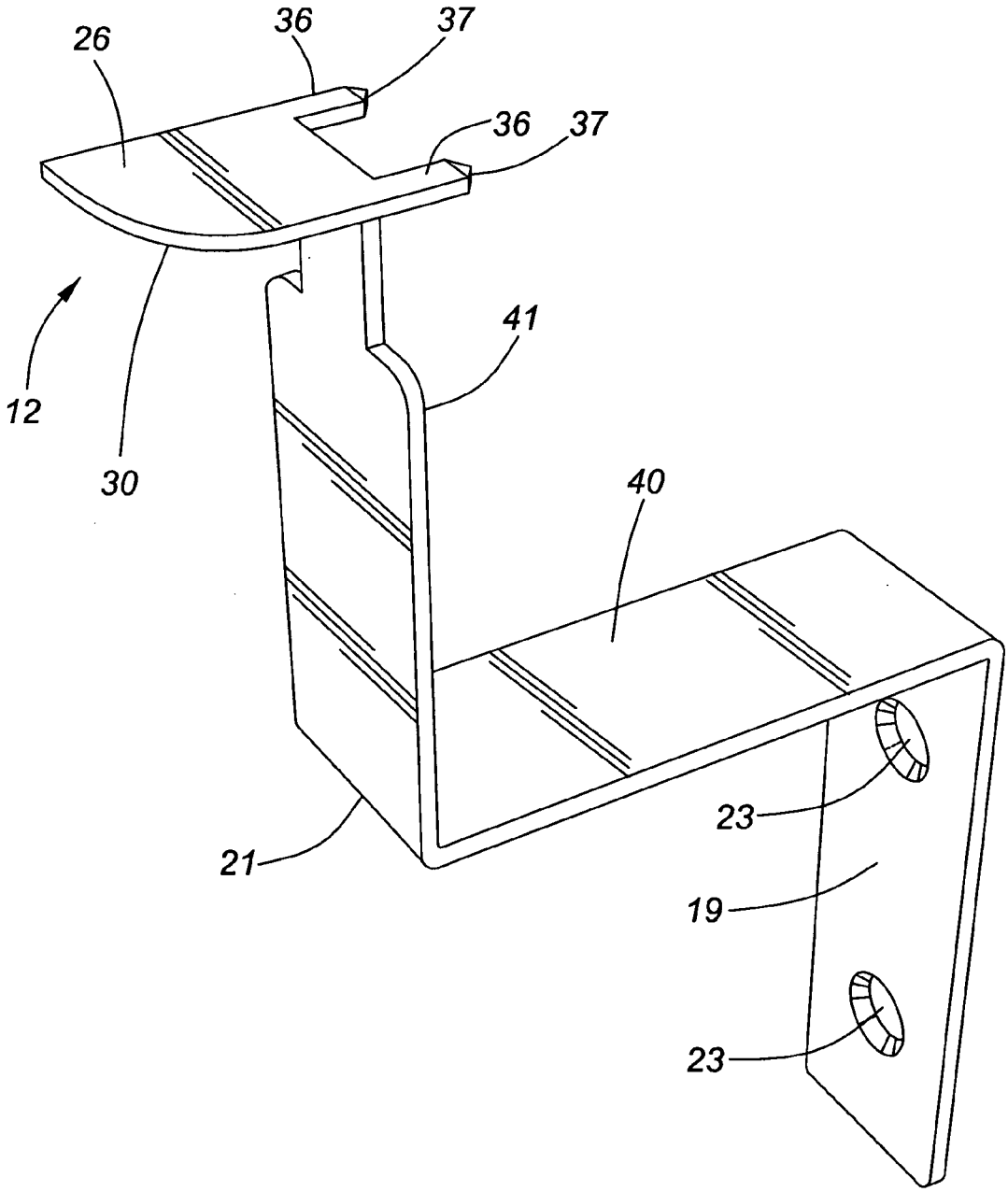
FIG. 3 shows the wall bracket of Variant 1.

FIG. 3 shows the bracket 12 of Variant 1, comprising wall support portion 19, handrail attachment means or head 26 comprising rounded corner or tongue element 30 and ears 36, and handrail support means 21 comprising of horizontal support arm 40 and vertical support arm 41. Wall support portion 19 comprises two holes 23; support arm 40 extends horizontally from wall support portion 19 at substantially a 90° angle, and vertical arm 41 extends vertically from support arm 40 also at substantially a 90° angle. At the top of vertical post 41, head 26 bends at substantially horizontally 90° and comprises rounded corner or tongue 30 on one end and ears 36 on the other end. In this preferred embodiment, tongue 30 is oriented to extend substantially away from wall support portion 19; however, it is possible to have ears 36 extend rather than tongue 30. Ears 36 serve the purpose of supporting teeth 37 and orienting vertical arm 41 so that it does not interfere with installation inside T-shaped upper channel 17 as seen on FIG. 5. Teeth 37 function as frictionally immobilizing elements when head 26 is twisted into locked position inside the upper portion of T-shaped channel 17.

Figure 4:
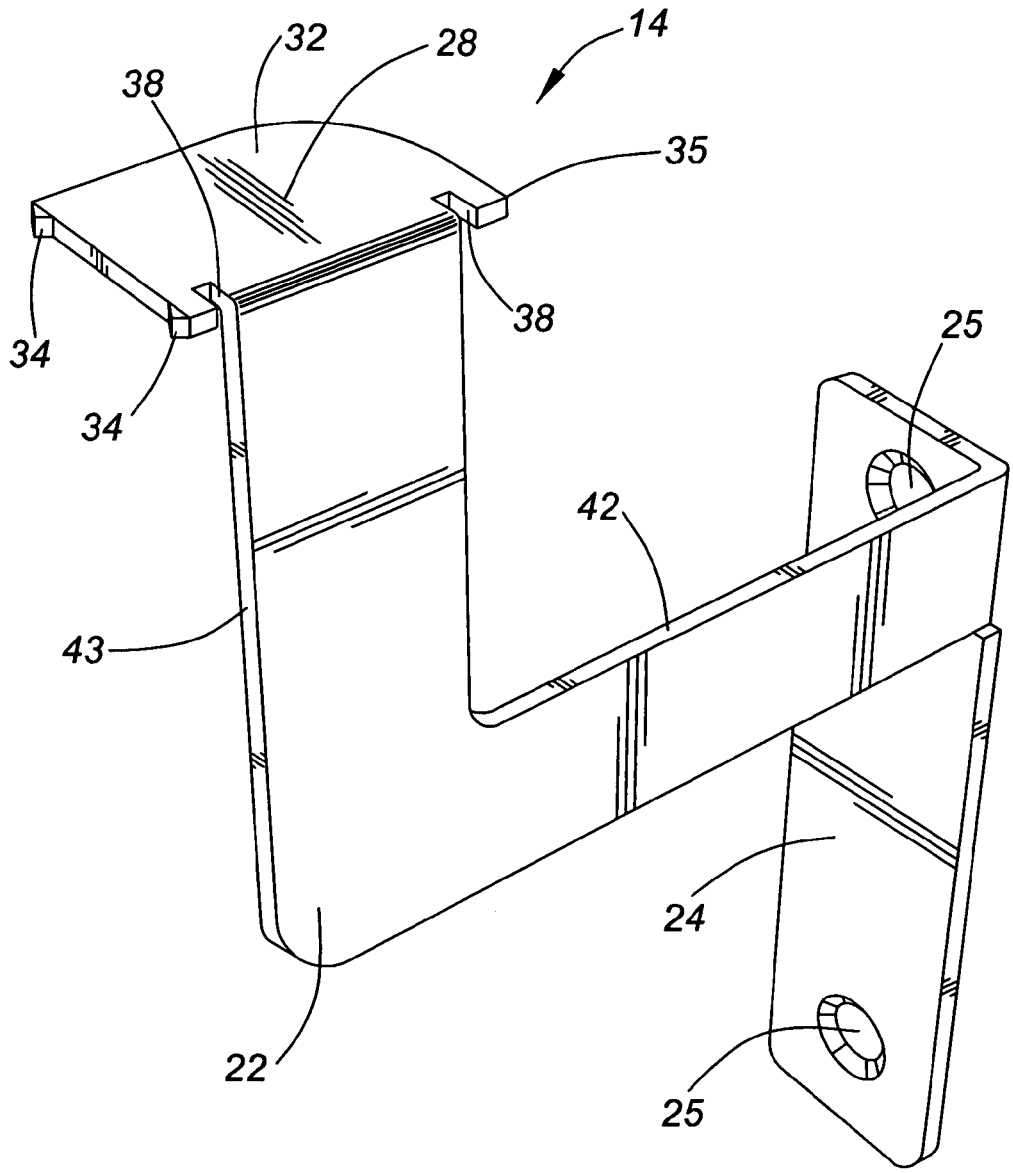
FIG. 4 shows the wall bracket of Variant 2.

Referring to FIG. 4, bracket 14 of Variant 2 comprises wall support portion 24 with holes 25, a handrail support means 22 comprising of horizontal support arm 42 and vertical support arm 43, wherein support arm 42 extends outwardly from wall support portion 24, and vertical arm 43 extending upwardly at substantially 90° from said support arm 42. Handrail attachment means or head 28 bends horizontally at substantially 90° from vertical post 43. Head portion 28 or tongue comprises two ends, one end has a square corner 35 and corner 32 having a rounded configuration, and the other end is provided with teeth 34. Teeth 34 are located on the opposite side of rounded corner 32 and square corner 35, and function as frictionally immobilizing elements when head 28 is rotated into locked position inside the upper portion 17 of T-shaped channel. Bend relief slots 38 are formed between vertical support arm 43 and square corner 35, and between vertical support arm 43 and one of the teeth 34. It is possible to make bracket 14 without bend relief slots 38. Bracket 14 differs from bracket 12 in the fact that support arm 42 and vertical arm 43 are not oriented in the same plane as wall attachment portion 24, and lie in the same plane with respect to each other. The characteristic of the design of bracket 14 is that horizontal support arm 42 (shown on FIG. 4) is much more resistant to vertical displacement than horizontal support arm 40 (shown on FIG. 3) due to its vertical rather than horizontal orientation of support arm 40. Support arm 40 is more adept at resisting horizontal force, but it is also more prone to bend out of shape. Support arm 42 is less resistant to horizontal displacement, but can hold more weight before failing.

It is important to note that many different configurations of the bracket are envisaged, from cast metal to bent sheet metal to molded plastic. Unlimited combinations and profiles of wall attachment portion 24, horizontal support arm 40, and vertical post 43 may be employed by those skilled in the art to achieve the desired characteristics of strength, aesthetic appeal, and ease of attachment to the wall. The most important element of the present invention is the interaction between lower 18 and upper 17 portions of T-shaped channel and a bracket's head 28.

Figure 5:
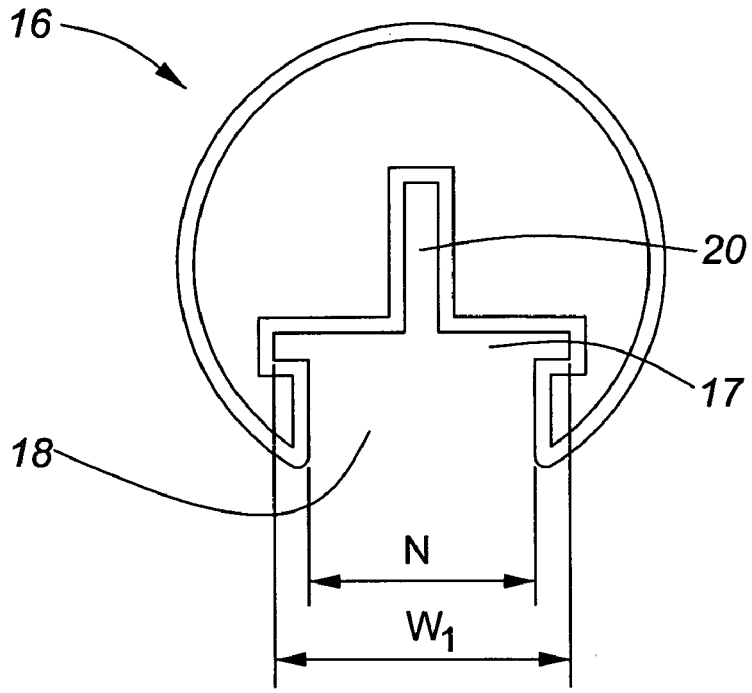
FIG. 5 shows the cross-section of the railing of the preferred embodiment.

FIG. 5 shows a cross-section of handrail 16, comprising lower portion of T-shaped channel 18, upper portion of T-shaped channel 17 and stress relief channel 20. Stress-relief channel 20 permits handrail 16 to flex slightly outwardly during installation of rail attachment head 26 or 28. It also serves to assist joining two railings 16 end-to-end, namely as a cavity to accommodate a fixing screw (not shown) for union joint 52 of FIG. 10. Railing 16 can be manufactured by aluminum extrusion, or of any other material. FIG. 5 also shows the geometric relationship of the T-shaped channel's lower and upper portions 18 and 17 respectively: for the invention to work properly, lower portion 18, or "N", is narrower than the upper portion 17, or "$W_1$". "N" must be at least 50% and no more than 95% of "$W_1$". In practice, the ratio should be in the range of 70% to 90%. In the preferred embodiment this ratio is approximately 80%.

Figure 6:
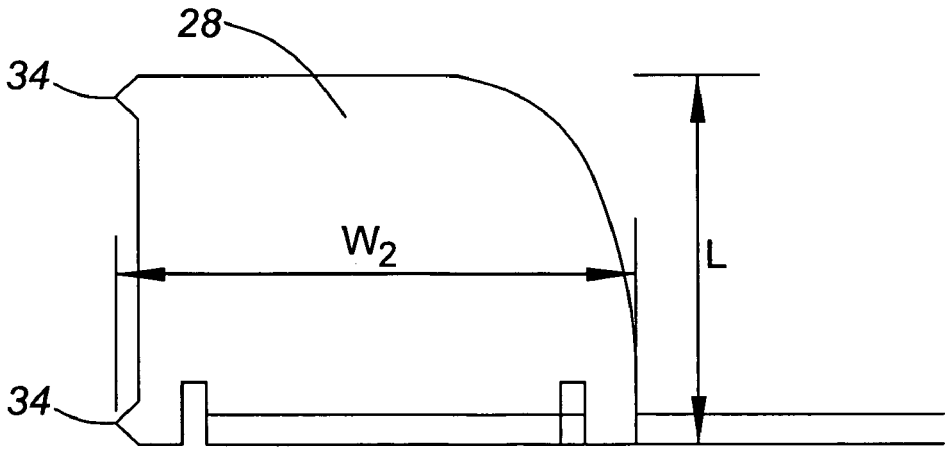
FIG. 6 shows the top view of the geometry of Variant 2's attachment head.

FIG. 6 demonstrates the geometric relationship of Variant 2 bracket's head 28: length "L" must be substantially the same size as the width of the T-shaped channel's lower portion 18, "N", of FIG. 5, and "$W_2$" must be substantially the same size as the width of T-shaped channel's upper portion 17, "$W_1$", of FIG. 5. This way, head 28 can be inserted into the lower portion 18 at any point, lifted into upper portion 17, twisted 90°, and thus remain in place, considering that the width "$W_1$" in the T-shaped channel's upper portion 17 and the width "$W_2$" of head 28 are substantially identical.

Figure 7:
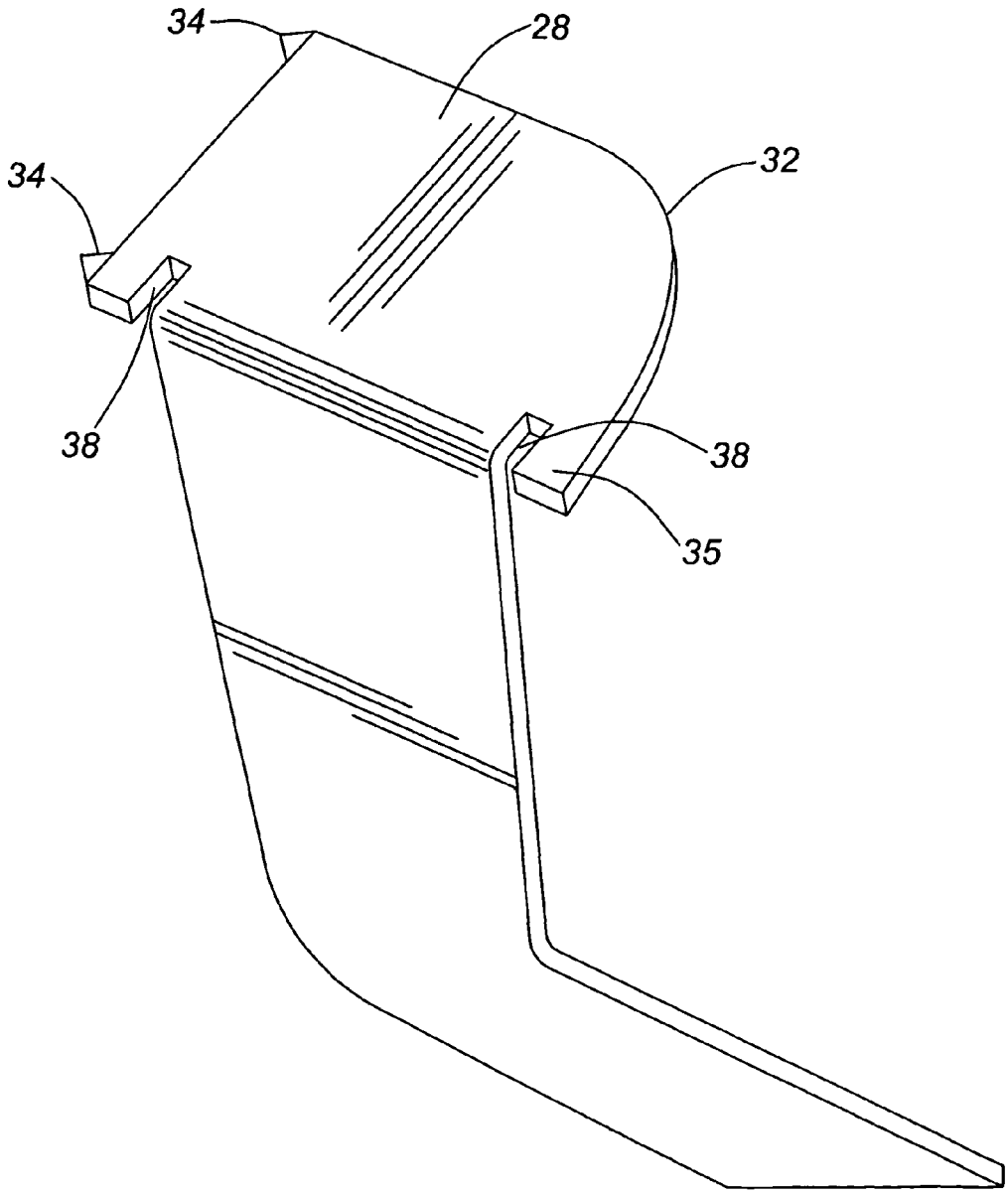
FIG. 7 shows the perspective view of the Variant 2 bracket's attachment head.

FIG. 7 shows Variant 2 bracket's head 28 comprising teeth 34 to cooperate with the inside walls of T-shaped channel's upper portion 17 in order to snugly immobilize said head 28 within said upper portion 17.

Figure 8:
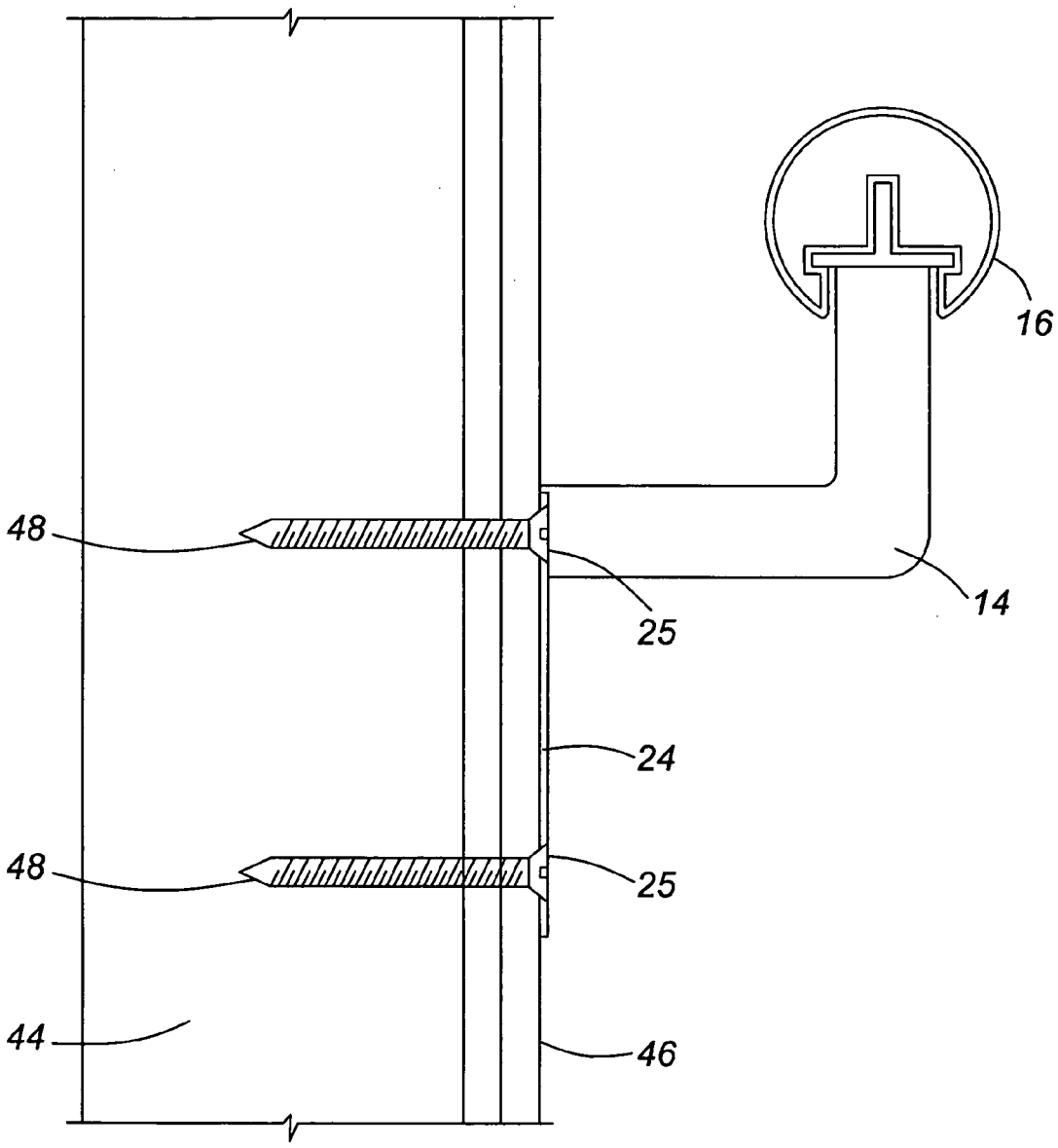
FIG. 8 shows a cross-section of assembly of Variant 2 in use.

FIG. 8 shows a cross-section of Variant 2, comprising railing 16 attached to bracket 14, which is affixed by screws 48 to a wall 46's stud 44. This is a typical installation of assembly 11 to provide assured support to a user along a wall.

Figure 9:
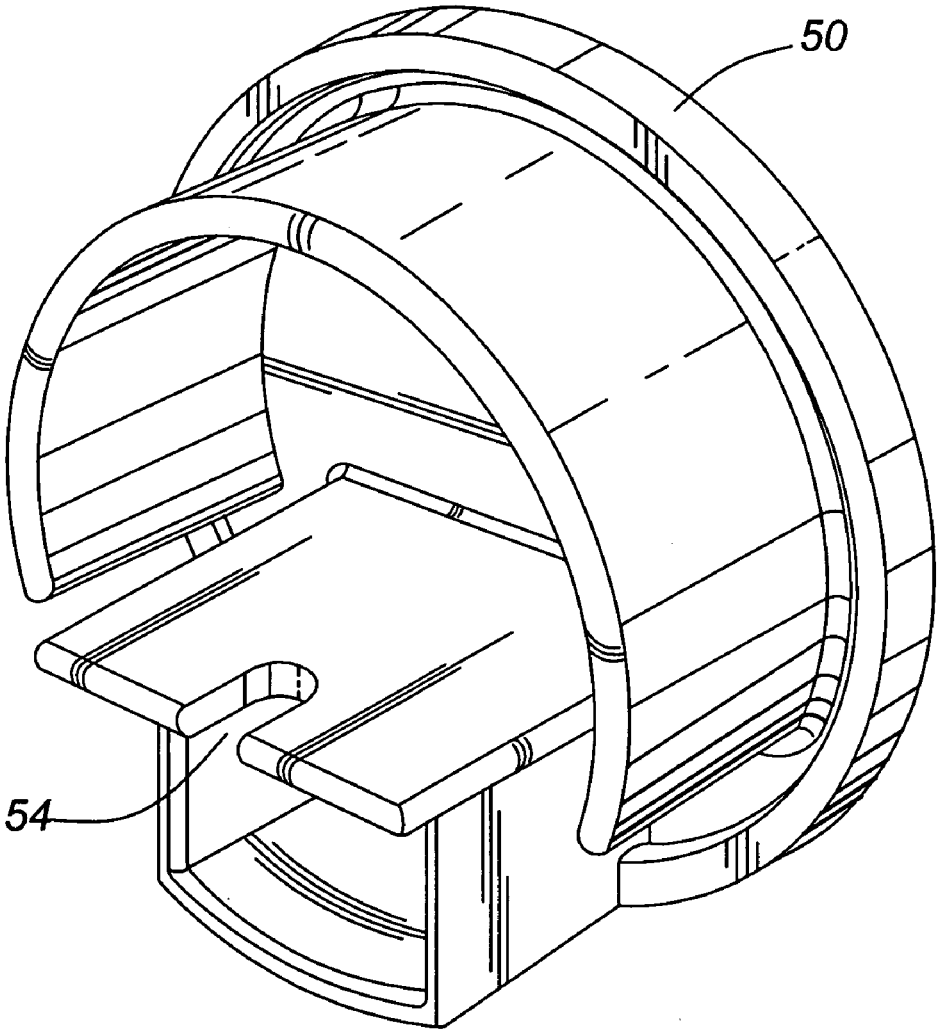
FIG. 9 shows an end cap.

FIG. 9 shows the end cap 50. A U-shaped recess 54 (can also be a formed through-hole) accommodates a fixing screw (not shown) that passes through said recess 54 and into stress relief channel 20 of handrail 16. Once a fixing screw is tightened through said recess 54, end cap 50 is immobilized within an extremity of handrail 16.

Figure 10:
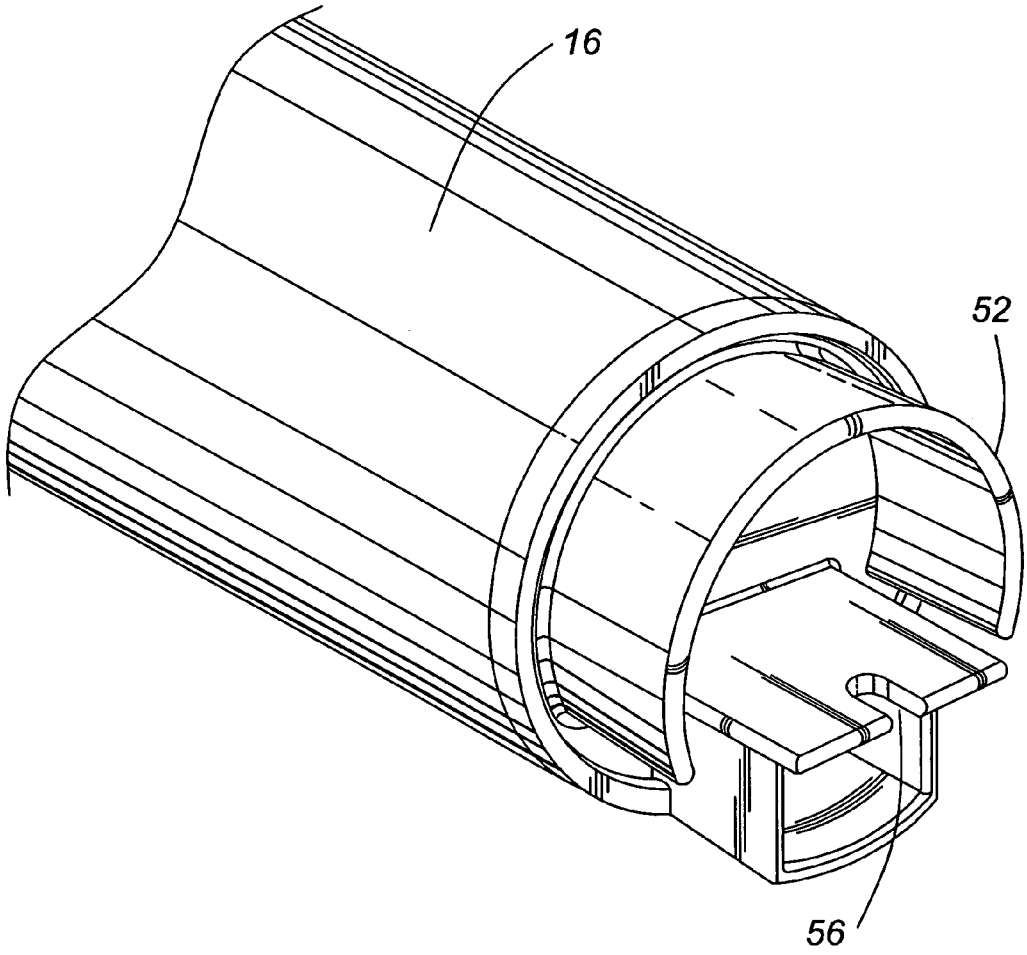
FIG. 10 shows the union joint of installed into one railing.

FIG. 10 shows the union joint 52 within handrail 16. Union joint 52's configuration is similar to end cap 50, with the exception that it is mirrored on both sides. Union joint 52 also comprises a U-shaped recess 56 (can also be a formed through-hole) to accommodate a fixing screw (not shown) that is affixed within stress relief channel 20 of handrail 16.

Figure 11:
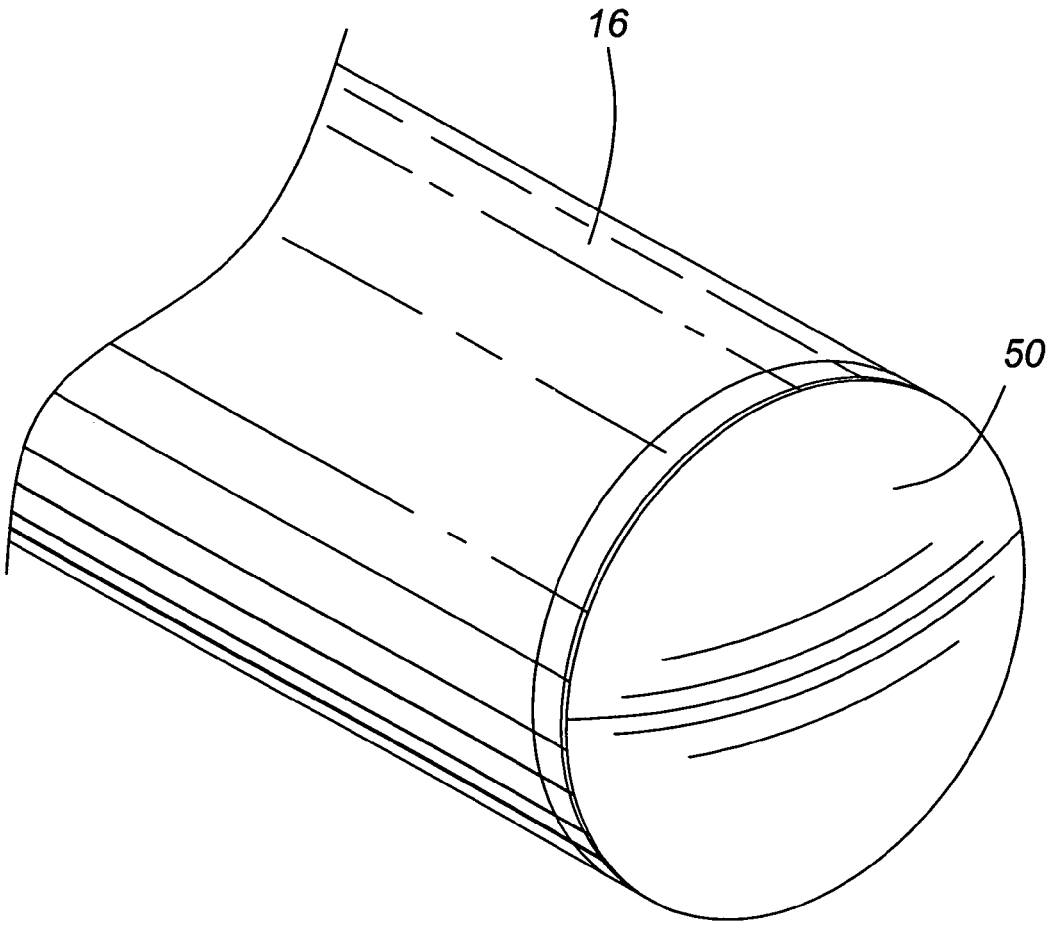
FIG. 11 shows a railing with an end cap.
Figure 12:
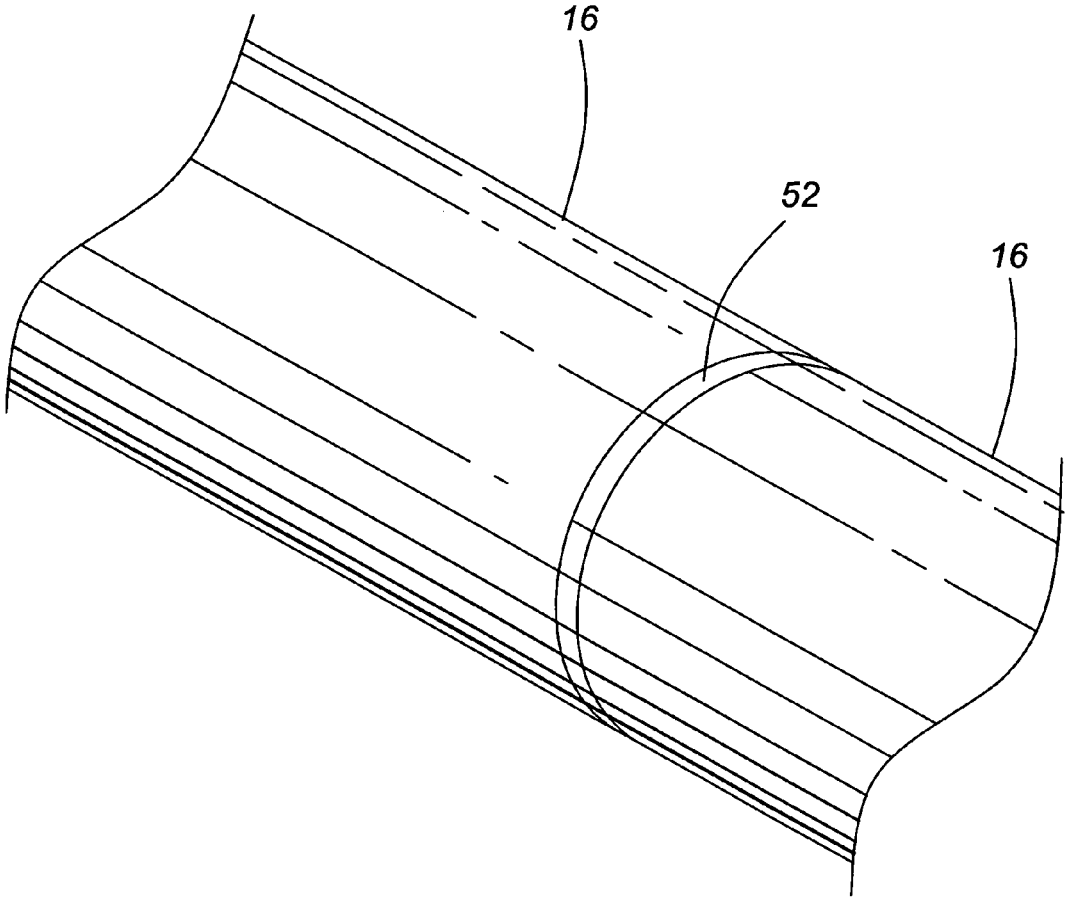
FIG. 12 shows two lengths of railing joined by a union joint.

FIG. 11 shows handrail 16 capped off with end cap 50. End cap 50 slides into the extremity of handrail 16, and serves an aesthetic and hygienic purpose. FIG. 12 shows two handrails 16 connected together with a union joint 52. Once joined, both handrails 16 provide a smooth, continuous surface for user's hands; such a joint is also aesthetically pleasing. In another embodiment (not shown), said union joint 52 is of a configuration to be completely shielded from view by handrails 16, thus providing a continuous, uninterrupted surface. Extremities of handrails 16 would simply meet at a seam, with the union joint 52 being invisible to the eye.

In operation (for brevity, we will use Variant 2 and a stud-retained wall), referring now to all Figures, the user will determine mounting locations in wall 46, preferably into a stud 44. Indicia (not shown) are marked on railing 16 to align attachment locations of wall support portion 24 with said stud 44. User inserts bracket 14's head 28 into railing 16's T-shaped channel's lower portion 18 in such a way that head 28's length "L" spans across the T-shaped channel's lower portion 18 width "N". Considering that "L" is approximately the same width as T-shaped channel's lower portion 18, "N", head 28 is insertable into the spot marked by indicia. User lifts or slides head 28 into the T-shaped channel's upper portion 17 and rotates bracket 14 substantially 90° in such a way that rounded corner 32 abuts a wall of upper portion 17 and facilitates a turning motion of head 28 inside T-shaped channel's upper portion 17, or "W". Teeth 34 are forced into the opposite wall of upper portion 17, locking head 28 inside said upper portion 17. Head 28 therein acts as a cam, wherein the 90° rotational movement of head 28 is translated into lateral immobilization of head 28 within upper portion 17 by the engagement of teeth 34 on one wall and square corner 35 on the opposite wall of the upper portion 17.

Considering that head 28's width "W" is substantially identical to the width of upper portion of T-shaped channel 17, "W", it snugly locks into place. Teeth 34 provide an additional means of immobilization of head 28 inside railing 16; teeth 34 dig into the walls of the T-shaped channel's upper portion 17. If the user makes a mistake, it is possible to undo this immobilization by reversing the procedure and moving head 28 to a different location inside upper portion 17. Presumably, user will orient all brackets 14 in the same direction.

Once the user is satisfied by the placement of bracket 14, assembly 11 can be mounted to wall 46 via screws 48 and holes 25. Once the assembly 11 is attached to wall 46, user can either seal off the end of railing 16 with an end cap 50 or install additional assemblies 10 to provide a continuous wall railing. As mentioned, railings 16 can be joined via a union joint 52. Union joint 52 can join linear and non-linear assembly 10 or 11 configurations. For example, if two walls meet at an angle, union joints 52 can be precisely made to join two handrails 16 for a continuous and uninterrupted handrail assembly 10 or 11.

The present invention is not limited to merely hallway and room walls. It can easily adapt to staircases: user simply bends rail attachment means 28 to or away from vertical arm 43 to accommodate a railing 16 that follows the incline of the staircase (not shown).

Interior and exterior walls may be classified as follows:

1. Walls with finishes [i.e. gypsumboard, lath and plaster, wallboards of all types] are supported on vertical wood or metal studs, known as frame construction, spaced to suit structural requirements or characteristics of the finishing materials. The studs are concealed behind these materials and their spacing is not usually visible. It is necessary to determine where the studs are by using stud locators or by drilling exploratory holes so that brackets could twisted into the handrails to match the locations of the studs.
2. Walls built of solid materials [i.e. brick, concrete masonry, cast concrete, stone] may have finishes applied directly over their surfaces. If wall finishes noted above are applied over wood or metal furrings that provide a space between them and the solid backing, the spacing of these furrings is usually not apparent, and their location must be determined in the same manner as studs.

Handrails that are secured to any wall must be anchored directly to solid materials described above or to studs or furrings. As noted above, it is necessary to locate these members before handrail brackets are anchored. Handrails or bars designed with brackets already fixed in place often are anchored wholly or partially to finishes that may not be substantial or that will deteriorate in use. Otherwise handrails must be custom-built so they can be anchored directly to studs or furrings. Some systems permit random spacing of brackets using fasteners of different sorts but this invention allows the brackets to be quickly twisted into place at locations that will provide permanent, solid bearing without any additional fasteners.

The system is designed to conform to current building codes in Canada and the United States; their requirements ensure that the handrails are capable of being solidly gripped, and of sustaining stresses of their users.

Advantages of the present invention are as follows: The system has two components: the handrail and the bracket. The bracket can be readily twisted into the extruded channel of the handrail at any point along its length. Once the locations of the studs are determined, the brackets are attached to the handrail and the entire assembly is secured to the wall using standard screws consistent with the type and position of the studs. On solid walls, the brackets are located to support the handrails at intervals determined by the structural characteristics of the handrail; suitable limitations are recommended in instructions furnished to users.

The handrails are made of aluminum extrusions that present a continuous slot allowing the bracket to be twisted securely in place, or removed by reverse-twisting if circumstances require. The extrusions will be of lengths allowing them to be installed in large rooms and long hallways without joints. The system can be installed sloped [parallel to stairways or ramps] or horizontal [parallel to floors].

Because handrails can be easily cut to length and brackets can be rapidly installed wherever needed or desired, labor costs are substantially reduced and disruption of users' facilities is minimized. Although this system can readily be installed by any competent workman, it is recommended that carpenters familiar with characteristics of wall construction install or verify the installation of the handrails.

The handrails can be cut to length and sold through retail establishments; sales 'by the foot' will appeal to the 'do it yourself' market, thereby improving safety of their occupancies. This product can also be sold and installed through commercial supply depots, contractors and any other distribution chain of supply. The finished assembly 10 or 11 of the present invention is no less attractive than custom-welded and modular systems currently available on the market, at a fraction of the cost.

The simple tubular handrail profile is unobtrusive and projects from walls only enough to permit the handrails to be comfortably gripped by users and allows hands to slide without obstruction to their movement. The attachment heads of the brackets are completely hidden from view within the handrail profile, providing an integrated appearance and resistance to tampering similar to that of custom-welded handrail systems of much higher cost.

The variable lengths of handrails result in few or no intermediate joints; the simple connection of brackets to handrails reduces labor costs and minimizes disruption during the construction period.

The invention claimed is:

1. A handrail assembly comprising:

a handrail, said handrail is adapted to be supported by a bracket, said bracket is adapted to be mounted on a vertical surface by means of a wall support portion, said bracket having a handrail support means, said handrail support means are adapted to be attached to said wall support portion by one end;

a handrail attachment means, said handrail attachment means is located on an opposite end of said handrail support means, a channel formed within said handrail;

wherein said channel has substantially a T-shaped configuration and forms an upper portion and a lower portion;

wherein the width of said handrail attachment means is substantially equal to the width of said upper portion of said channel and the length of said handrail attachment means is substantially equal to the width of said lower portion of said channel;

wherein said handrail attachment means is adapted to be firstly inserted lengthwise into the lower portion of said channel and secondly to be releasably and frictionally locked within the upper portion of said channel by means of 90 degree twist of said handrail attachment means within the upper portion of said channel;

wherein said handrail attachment means further comprises a biting means which are locked within said upper portion of said channel by biting into inner vertical side walls of said upper portion of said channel, wherein said handrail support means comprises a horizontal arm portion and vertical arm portion, said horizontal arm portion extends horizontally outwardly from said wall support portion, and said vertical arm portion is connected to said horizontal arm portion and extends vertically from said horizontal arm portion and wherein said handrail attachment means comprises a head portion formed at an end of said vertical arm portion, said head portion extends substantially horizontally from said vertical arm portion, and wherein said head portion is provided with a rounded portion formed at one end of said head portion and wherein said biting means comprises a number of teeth formed at the opposite end of said head portion, said rounded portion and said teeth are adapted to facilitate secure and releasable locking of said head portion within said T-shaped channel.

2. Handrail assembly according to claim 1, wherein said channel extends throughout the entire length of said handrail, said handrail attachment means is adapted to be securely and releasably locked at any desired point along the length of said channel.

3. Handrail assembly according to claim 1, wherein said handrail is provided with a stress-relief channel, said stress-relief channel extends vertically above the upper portion of said T-shaped channel, wherein said stress-relief channel is provided to facilitate easy placement of said head portion within said T-shaped channel.

4. A handrail assembly for mounting on a wall comprising a bracket adapted to support a handrail, wherein said bracket comprises a handrail support means having, on one end a wall support portion adapted to be mounted on a vertical surface, and a handrail attachment means on the other end, and a handrail, adapted to be supported by said handrail support means, wherein said handrail comprises a handrail channel located within said handrail, wherein said channel has substantially a T-shaped configuration and forms an upper portion and a lower portion;

wherein the width of said handrail attachment means is substantially equal to the width of said upper portion of said channel and the length of said handrail attachment means is substantially equal to the width of said lower portion of said channel;

wherein said handrail attachment means further comprises a biting means, said handrail attachment means is adapted to be firstly inserted lengthwise into the lower portion of said channel and secondly to be releasably and frictionally locked by said biting means within the upper portion of said channel by means of 90 degree twist of said handrail attachment means within the upper portion of said channel, and wherein said handrail attachment means is adapted to be inserted at any point within said handrail channel, wherein said handrail support means comprises a horizontal arm portion and vertical arm portion, said horizontal arm portion extends horizontally outwardly from said wall support portion, and said vertical arm portion is connected to said horizontal arm portion and extends vertically from said horizontal arm portion and wherein said handrail attachment means comprises a head portion formed at an end of said vertical arm portion, said head portion extends substantially horizontally from said vertical arm portion, and wherein said head portion is provided with a rounded portion formed at one end of said head portion and wherein said biting means comprises a number of teeth formed at the opposite end of said head portion, said rounded portion and said teeth are adapted to facilitate secure and releasable locking of said head portion within said T-shaped channel.

5. A handrail assembly according to claim 4, wherein said handrail channel is continuous.

6. A handrail assembly according to claim 4, wherein the ratio between the width of said lower and upper portion of said "T" of said channel is between 50% and 95%.

* * * * *